US007435288B2

(12) United States Patent
Lee

(10) Patent No.: US 7,435,288 B2
(45) Date of Patent: Oct. 14, 2008

(54) SYSTEM FOR FILTERING PARTICULATE MATTER OF DIESEL PARTICULATE FILTER

(75) Inventor: Kangsoo Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 30 days.

(21) Appl. No.: 11/648,740

(22) Filed: Dec. 29, 2006

(65) Prior Publication Data

US 2008/0072756 A1 Mar. 27, 2008

(30) Foreign Application Priority Data

Sep. 26, 2006 (KR) ..... 10-2006-0093700

(51) Int. Cl.
*B03C 3/68* (2006.01)

(52) U.S. Cl. ..... 96/18; 55/282.3; 55/DIG. 10; 60/275; 95/3; 95/74; 95/78; 96/19; 96/28; 96/56; 96/60; 96/62

(58) Field of Classification Search ..... 96/60, 96/62, 64, 18, 19, 28, 55, 56; 55/282.3, DIG. 10; 95/2, 3, 70, 73, 74, 78; 60/275
See application file for complete search history.

(56) References Cited

U.S. PATENT DOCUMENTS

| | | | | |
|---|---|---|---|---|
| 3,768,258 | A * | 10/1973 | Smith et al. | 60/275 |
| 4,108,615 | A * | 8/1978 | Satterthwaite | 95/2 |
| 4,207,083 | A * | 6/1980 | Gelhaar et al. | 96/64 |
| 4,376,637 | A * | 3/1983 | Yang | 95/74 |
| 4,521,228 | A * | 6/1985 | Daar et al. | 96/19 |
| 5,557,923 | A * | 9/1996 | Bolt et al. | 60/274 |
| 5,707,428 | A * | 1/1998 | Feldman et al. | 96/54 |
| 5,759,487 | A * | 6/1998 | Jung | 422/22 |
| 6,136,074 | A * | 10/2000 | Okamoto et al. | 96/62 |
| 6,156,099 | A * | 12/2000 | Hironaka et al. | 95/74 |
| 6,171,376 | B1 * | 1/2001 | Hironaka et al. | 96/28 |
| 6,185,934 | B1 * | 2/2001 | Teboul | 60/297 |
| 6,235,090 | B1 * | 5/2001 | Bernstein et al. | 96/57 |
| 6,251,170 | B1 * | 6/2001 | Hironaka et al. | 96/28 |
| 6,471,746 | B2 * | 10/2002 | Hagglund et al. | 95/78 |
| 6,623,544 | B1 * | 9/2003 | Kaura | 95/3 |
| 6,660,068 | B1 * | 12/2003 | Garner et al. | 95/283 |
| 6,858,064 | B2 * | 2/2005 | Bologa et al. | 95/65 |
| 6,962,620 | B2 * | 11/2005 | Chang et al. | 96/60 |
| 7,112,236 | B2 * | 9/2006 | Hoverson et al. | 95/78 |
| 7,264,658 | B1 * | 9/2007 | Heckel et al. | 96/62 |
| 2006/0021503 | A1 * | 2/2006 | Thaler | 95/70 |

FOREIGN PATENT DOCUMENTS

| | | | | |
|---|---|---|---|---|
| JP | 6-126212 | A * | 5/1994 | 96/19 |

* cited by examiner

*Primary Examiner*—Richard L Chiesa
(74) *Attorney, Agent, or Firm*—Morgan Lewis & Bockius LLP

(57) ABSTRACT

The present invention relates to a system for effectively filtering particulate matter from exhaust gas. Exemplary embodiments of the invention provides a system for capturing diesel-powered vehicle particulate matter in exhaust gas, the system including: a detour channel at the interior of the entrance to the diesel particulate filter, an electrode located in front of the detour channel and operable to ionize the particulate matter, and a control unit operable to control operation of the electrode.

2 Claims, 5 Drawing Sheets

SYSTEM FOR FILTERING PARTICULATE MATTER OF DIESEL PARTICULATE FILTER

CROSS-REFERENCE TO RELATED APPLICATION

This application claims priority to and the benefit of Korean Patent Application No. 10-2006-0093700 filed in the Korean Intellectual Property Office on Sep. 26, 2006, the entire contents of which are incorporated herein by reference.

BACKGROUND OF THE INVENTION (a) Field of the Invention

The present invention relates to a system for filtering particulates.

(b) Description of the Related Art

The control of particulate emissions from diesel engines is one of the major technical issues facing the automotive industry, especially in light of tightened regulations on vehicle particulate emissions. Under EURO-5 for example, a set of standards for pollutant emissions from diesel and petrol cars, stricter limits are being placed on the concentration of certain nitric oxides (NOx), carbonized hydrogen (HC), and particulate matter. The regulations will be broadened to cover, amongst other aspects, the weight, size, and amount of particulates generated. A host of other countries outside Europe is likewise concerned about the health and environmental hazards posed by particulate emissions and in search of ways to tackle this problem. Accordingly, there is a need in the art for filtering apparatuses to reduce particulate matter in exhaust gas.

Most conventional diesel particulate filters (DEF) capture particulates that are over 10 μm in diameter. This is a significant limitation given that the average particulate matter in vehicle exhaust gas, e.g. from diesel powered engines, is under 2.5 μm in diameter, thereby escaping filtration and releasing into the air. Smaller particulate matters can remain airborne longer, which increases their potential for harm to the environment and public health.

While conventional methods for removing particulates exist, they suffer from a variety of drawbacks. For instance, the use of filters having minute pores can lead to increased exhaust gas pressure over the filter and the manufacturing of such filters involve a difficult catalyst coating process.

Another filtering method operates on an apparatus that agglomerate particulate matter and that is situated at a front exhaust pipe connecting the engine to the diesel particulate filter. The disadvantage to this method lies in the agglomeration of particulate matter of non-uniform size, thus resulting in increased exhaust gas pressure and clogged front exhaust pipe. The formation of large particles from non-spherically shaped particulates can also disrupt the flow of exhaust gas. The front exhaust pipe is also prone to oxidization, which can lead to deterioration in the pipe structure.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a system for filtering particulate matter from vehicle exhaust gas using a small amount of electric power. The present invention has the advantages of preventing an increase in exhaust gas pressure on the filter by agglomerating only filtered particulate matter and reducing cost by its adaptation to conventional filtering apparatus.

In some exemplary embodiments, the present invention provides a system for filtering particulate matter, the system including: a detour channel located at the interior of the entrance to the diesel particulate filter, an electrode, or a pair of electrodes, positioned before the detour channel and operable to ionize the particulate matter, and a control unit operable to control operation of the electrode.

In alternative embodiments, the invention provides a system wherein the rear portion of the detour channel is formed as a conductive metal plate and one end of the rear portion is closed. The rear portion of the detour channel can include an electronically controlled heating unit to burn agglomerated particulate matter and a particulate matter detecting unit to detect the status of the agglomerated particulate matter and to transfer corresponding signals to the control unit.

According to another embodiment of the present invention, a rear portion of the detour channel can be open and an electronically controlled particle agglomerator for agglomerating particulates provided at the detour channel.

Figure 1:
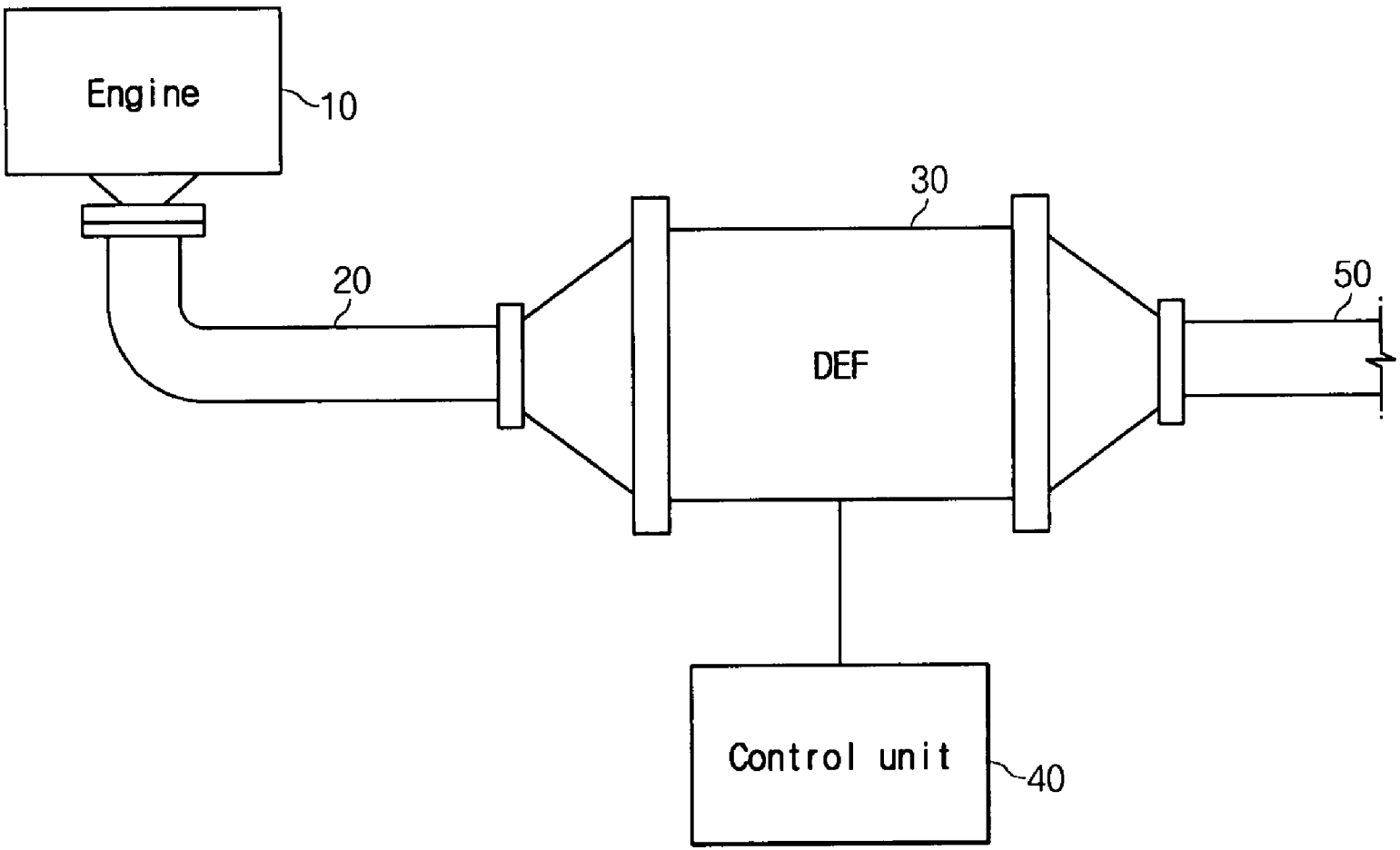
FIG. 1 is a schematic of a system for filtering particulate matter according to one exemplary embodiment of the invention.

<Description of Reference Numerals Indicating Primary Elements in the Drawings>

| | |
|---|---|
| 10: engine | 20: front exhaust pipe |
| 30: diesel particulate filter | 40: control unit |
| 50: rear exhaust pipe | 100: detour channel |
| 110: electrode | 140: heating unit |
| 150: particulate matter detector | 180: particle agglomerator |

DETAILED DESCRIPTION OF THE EMBODIMENTS

Exemplary embodiments of the present invention will hereinafter be described in detail with reference to the accompanying drawings.

Figure 2:
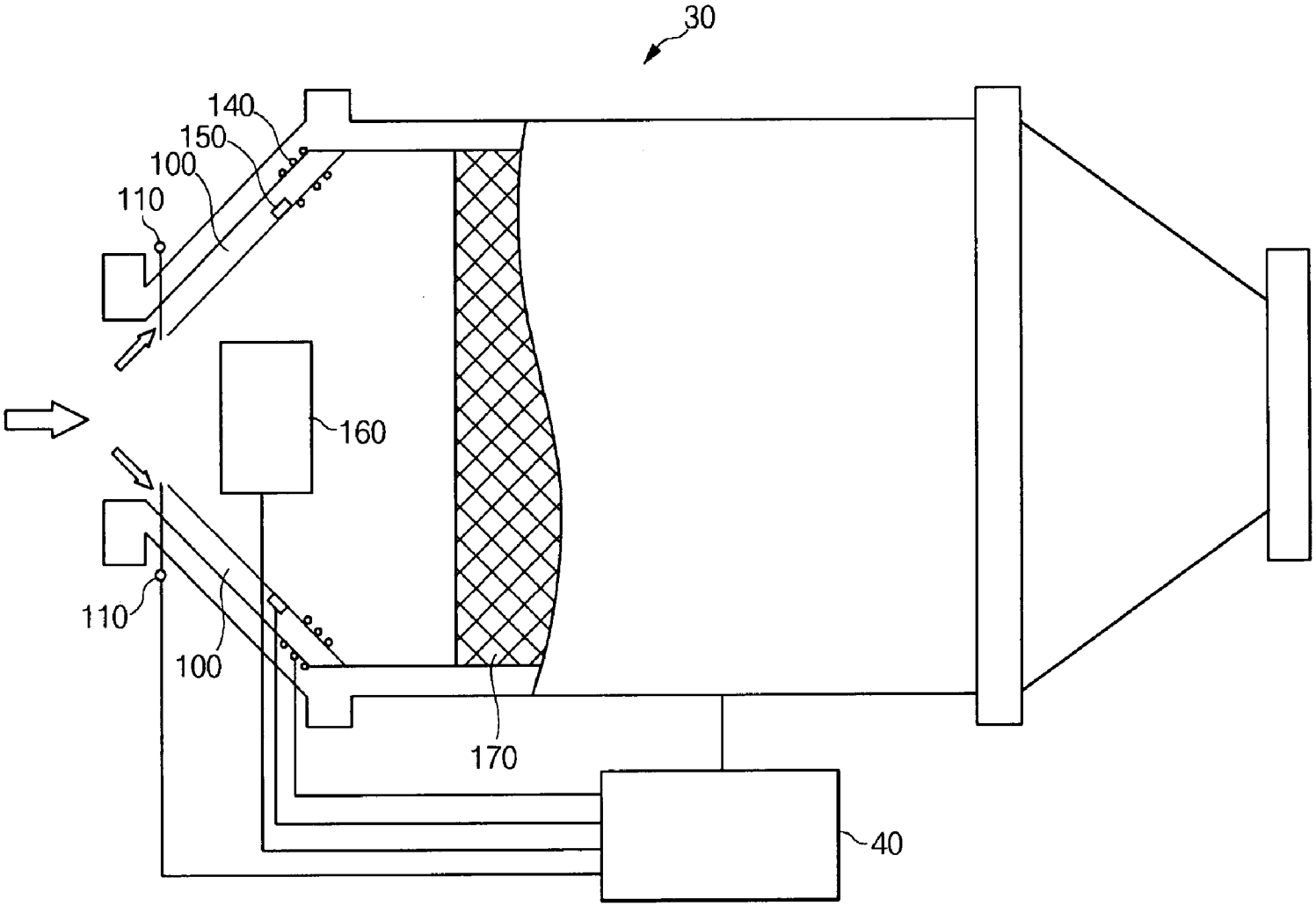
FIG. 2 is a cross-sectional view showing the structure of a system for filtering particulate matter according to a first exemplary embodiment of the invention.
Figure 3:
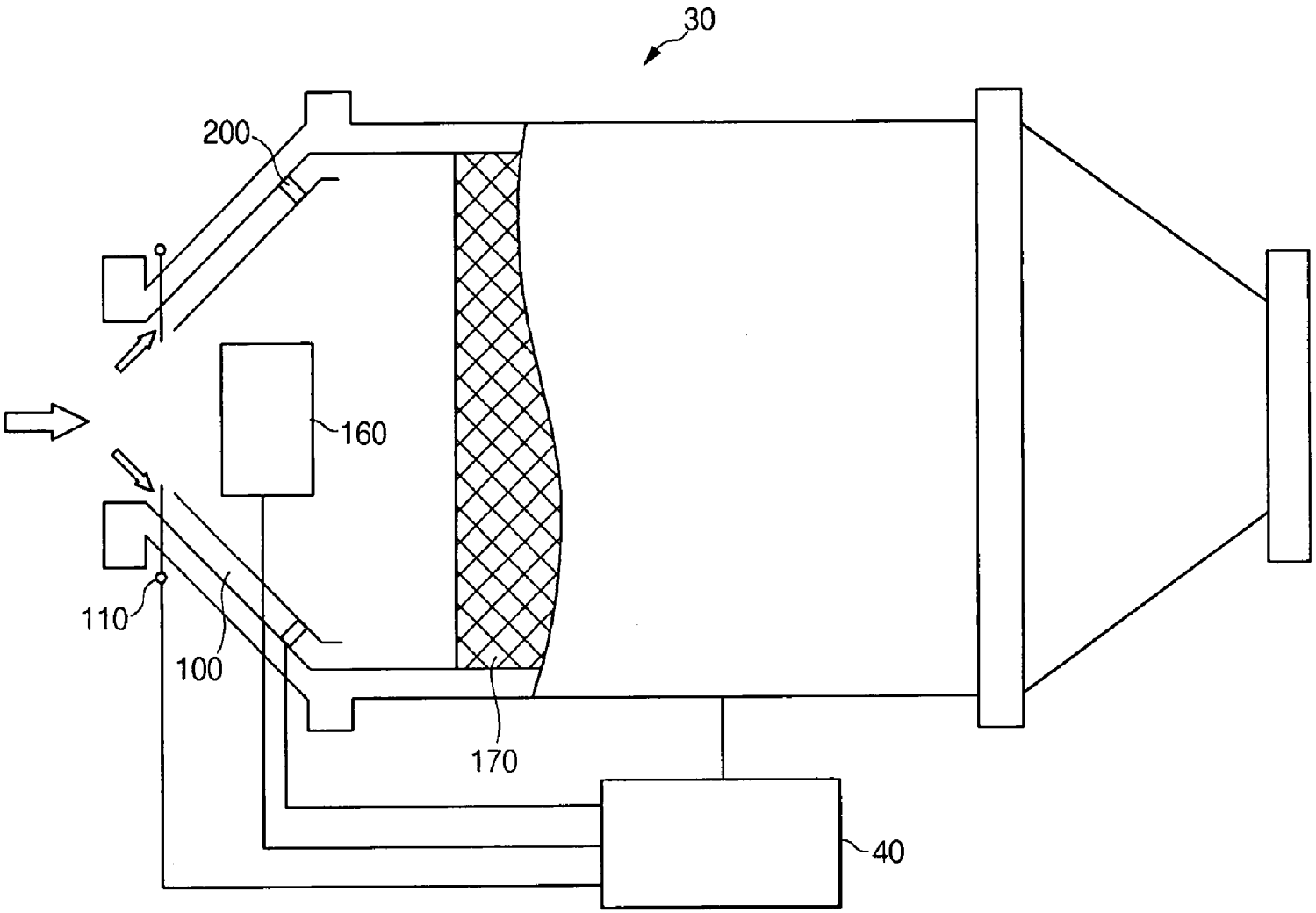
FIG. 3 is a cross-sectional view showing the structure of a system for filtering particulate matter according to a second exemplary embodiment of the invention.

As exemplified in FIG. 1, the system for filtering vehicule particulate matter can include a diesel particulate filter 30 and a control unit 40. In some embodiments, as illustrated in FIG. 2 and FIG. 3, the diesel particulate filter 30 includes a diffuser 160 provided at a front portion of the diesel particulate filter 30 and a filter 170 provided at a middle portion of the diesel particulate filter 30. The diesel particulate filter 30 is located between a front exhaust pipe 20 and a rear exhaust pipe 50 as shown in FIG. 1. In this configuration, exhaust gas from engine 10 flows through the front exhaust pipe 20 into the diesel particulate filter 30, which filters the exhaust gas. The filtered exhaust gas is then released into the air through the rear exhaust pipe 50.

The control unit 40, which controls operations of the system, may comprise a processor, memory and associated hardware, software and/or firmware as may be selected and programmed by a person of ordinary skill in the art based on the teachings of the present invention.

In the embodiment of FIG. 2, diesel particulate filter 30 is provided with one or more detour channels 100 along the interior of the entrance of the diesel particulate filter 30. A rear portion of the detour channel 100 is formed as a conductive metal plate and the end of the rear portion closed off. One or more electrode 110 is provided near the front opening of the detour channel 100, and the detour channel 100 is provided with a heating unit 140 and a particulate matter detector 150 at a rear portion thereof. Voltage is applied to electrode 110 as dictated by control unit 40, which ionizes the particulates. The heating unit 140 then burns the agglomerated particulates as dictated by control unit 40.

In some embodiments, the heating unit 140 is formed as a coil of high resistivity encircling the detour channel 100. In alternative embodiments, heating unit 140 can include an electrode that generates sparks through application of high voltage or adopt any configuration known to those of skill in the art.

The particulate matter detector 150 identifies the status, e.g. size and mass, of the agglomerated particulates accumulating at the rear portion of the detour channel 100 and transfers a corresponding signal(s) to the control unit 40. Accordingly, control unit 40 is linked to electrode 110, the heating unit 140, the diffuser 160, and the particulate matter detector 150.

The control unit 40, being operable to direct the application of voltage to the electrode 110 to ionize the particulates in the exhaust gas and to receive the status signal(s) from the particulate matter detector 150, times the burning of particulates and controls the operation of the heating unit 140.

Hereinafter, operation of the first exemplary embodiment of the present invention will be described in detail.

In this embodiment of the invention, exhaust gas from engine 10 flows into the diesel particulate filter 30 through the front exhaust pipe 20. The electrode(s) 110 positioned near or at the opening of the detour channel 100 then ionizes these particles.

The ionized particles are subjected to an electric attractive force and a resisting force due to viscosity, thus moving vertically to the direction of particle flow, i.e. to the detour channel. That is, the ionized particles change their course of movement as compared to their original direction of flow because of the combined effect of the attractive force and resisting force. The distance ($Z_P$) that the particles move vertical to the direction of flow can be represented by the following formula relating electric attractive force and the resisting force due to viscosity.

$$Z_P = \frac{n_P e C}{3\pi\mu D_P} \quad \text{[Equation 1]}$$

wherein $n_P$ indicates charge number per particle, e indicates normal electron charge, C indicates Cunningham coefficient for slippage correcting, μ indicates viscosity, and $D_P$ indicates particle diameter.

Referring to Equation 1, the distance ($Z_P$) that the particles move vertical to the direction of flow is inversely proportional to the diameter ($D_P$) of the particle. In other words, the smaller the diameter ($D_P$) of the particle, the further the particles will move from the center of the diesel particulate filter 30. Accordingly, particulates of relatively small diameter ($D_P$) will move to the detour channel 100 located on the interior of an entrance of the diesel particulate filter 30. Referring to FIG. 2, in a first exemplary embodiment, the rear portion of the detour channel is closed and thus the particle cannot move to the diesel particulate filter. Referring to FIG. 3, in a second exemplary embodiment, the end of the detour channel is opened and thus the particle moves to the diesel particulate filter.

The inertia on the particles comprising the exhaust gas is proportional to $\rho_g v^2 D_P^2$ wherein $\rho_g$ indicates density of exhaust gas, and v indicates velocity of exhaust gas. Accordingly, the small the particle size/diameter ($D_P$), the lesser the inertia on the particles, thus propelling them towards the detour channel 100.

The particulates then move towards the rear portion of the detour channel 100. In embodiments wherein the rear portion of the detour channel 100 is formed as a conductive metal plate, the particulates will collide with one another and agglomerate at or near the rear portion of the detour channel 100.

The particulate matter detector 150 which is located at the rear portion of the detour channel 100 detects the status of the agglomerated particulate matters and then transfers a corresponding signal(s) of the status to the control unit 40. The control unit 40 controls the timing of the burning of particulate matters based on the status of agglomerated particulate matter and activates the heating unit at the proper time. The particulate material detector 150 detects the masses and sizes of the agglomerated particulate materials and when the agglomerated particulate materials are larger or heavier than a predetermined value, the control unit controls the heating unit to burn the particulate.

Referring to FIG. 3 hereinafter, the second exemplary embodiment of the present invention will be described in comparison to the first exemplary embodiment of the present invention.

The system of FIG. 3 includes the detour channel 100 is provided with a particle agglomerator 180. The particle agglomerator 180 agglomerates particulate matter flowing into the detour channel 100 under the control of the control unit 40.

Figure 4:
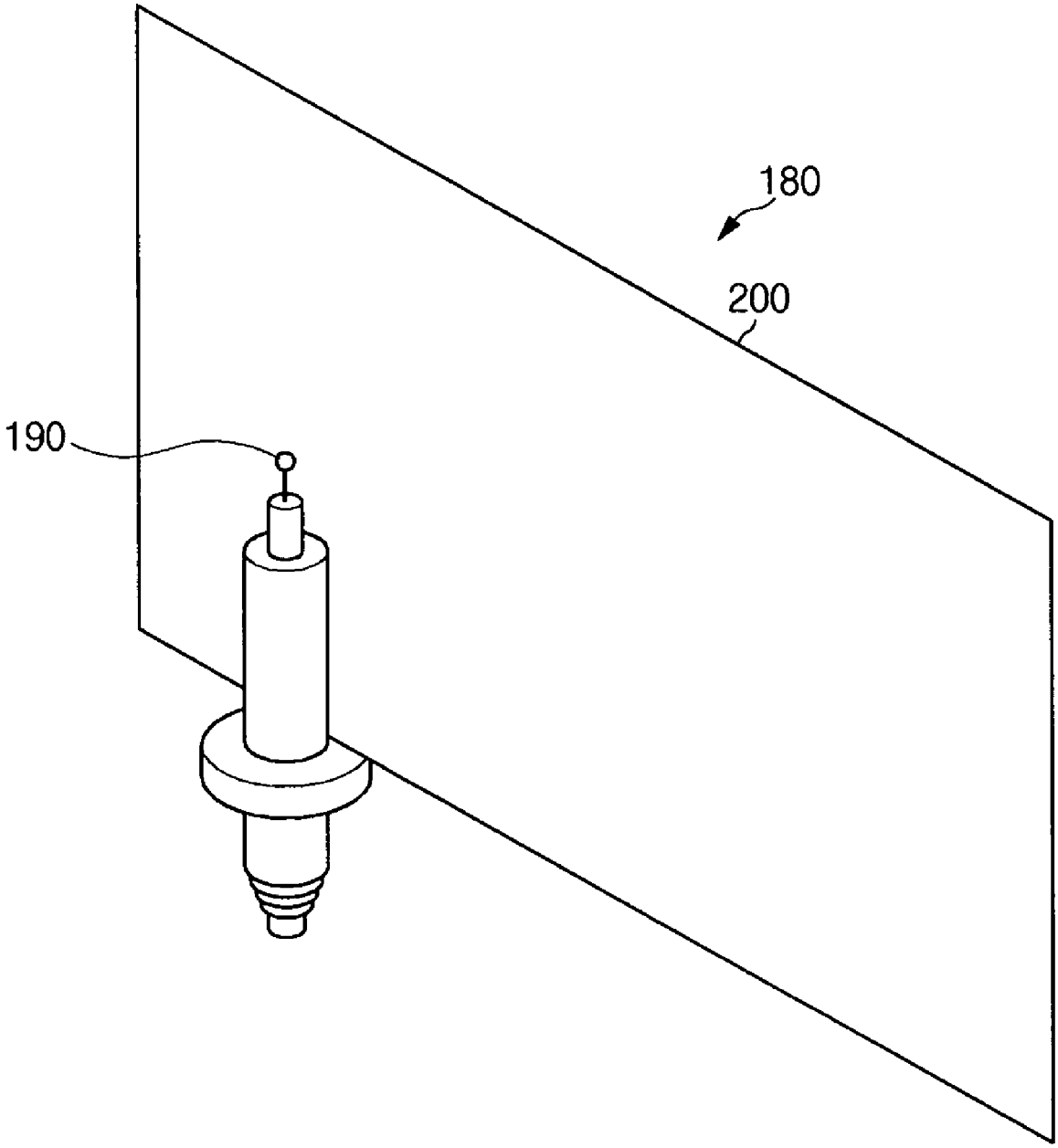
FIG. 4 is a schematic of a particle agglomerator of the second exemplary embodiment of the invention.
Figure 5:
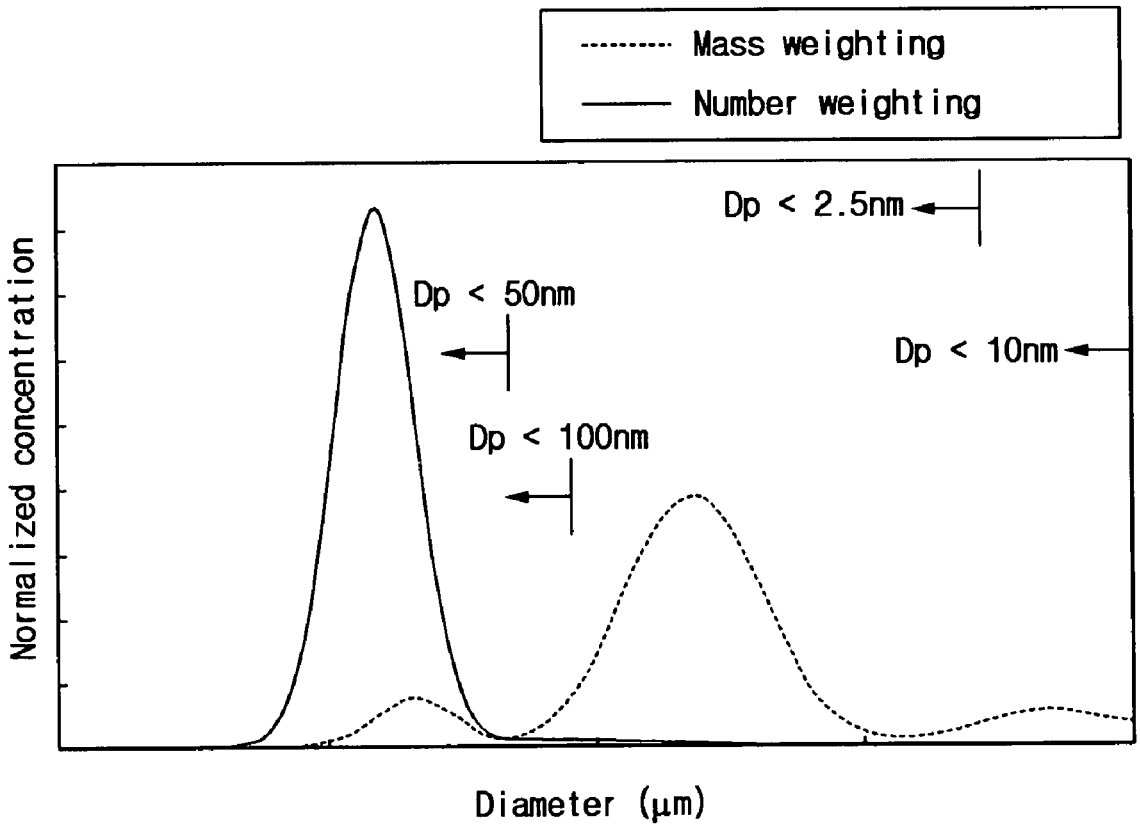
FIG. 5 is an exemplary concentration distribution graph of different sized particles in vehicle exhaust gas.

As shown in FIG. 4, the particle agglomerator 180 includes a first electrode 190 which ionizes the particulates by discharging sparks and a second electrode 200 which attracts the ionized particulates with an electrical attractive force and agglomerates the particulates.

The rear portion of the detour channel 100 is open. As such, agglomerated particles flow into the diesel particulate filter through the detour channel 100, rejoining other exhaust gases in being filtered by filter 170 and then releasing into the air.

According to an exemplary embodiment of the present invention, particulates in the exhaust gas can be filtered using a small amount of electricity and thereby reduce air pollution originating from vehicle emissions.

In addition, according to an exemplary embodiment of the present invention, only small particulate matters included in the exhaust gas are respectively agglomerated and filtered by a diesel particulate filter, and thus exhaust gas pressure can be maintained under a certain level.

Furthermore, an exemplary embodiment of the present invention can be adapted for use with conventional diesel particulate filters, thereby reducing the cost of manufacturing the present invention.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth herein.

What is claimed is:

1. An emission control system comprising:

at least one detour channel located on an interior of a particulate filter, wherein a rear portion of the detour channel comprises a conductive metal plate, and an end of the rear portion is closed, wherein the rear portion of the detour channel further comprises a heating unit operable to burn particulate matter agglomerated and a particulate matter detecting unit operable to detect a status of the agglomerated particulate matter and transfer a signal corresponding thereto to the control unit;

at least one electrode disposed near an opening of said at least one detour channel and operable to ionize particulate matter; and a control unit operable to control operation of the electrode.

2. The system of claim 1, wherein the particulate filter is a diesel particulate filter.

* * * * *